US005116805A

United States Patent [19]

Pope et al.

[11] Patent Number: 5,116,805

[45] Date of Patent: May 26, 1992

[54] THERMAL TRANSFER RECEIVER

[75] Inventors: John A. Pope; Roger N. Barker, both of Essex; Richard A. Hann, Suffolk, all of England

[73] Assignee: Imperial Chemical Industries PLC, London, England

[21] Appl. No.: 555,735

[22] Filed: Jul. 23, 1990

[30] Foreign Application Priority Data

Jul. 21, 1989 [GB] United Kingdom ..... 8916723
Nov. 9, 1989 [GB] United Kingdom ..... 8925279

[51] Int. Cl.[5] ..... B41M 5/035; B41M 5/26

[52] U.S. Cl. ..... 503/227; 428/195; 428/207; 428/323; 428/913; 428/914

[58] Field of Search ..... 8/471; 428/195, 913, 428/914, 207, 323; 503/227

[56] References Cited

U.S. PATENT DOCUMENTS 4,720,480 1/1988 Ito et al. ..... 503/227
4,778,782 10/1988 Ito et al. ..... 503/227

*Primary Examiner*—Bruce H. Hess
*Attorney, Agent, or Firm*—Cushman, Darby & Cushman

[57] ABSTRACT

A thermal transfer receiver sheet with improved handling properties comprises a sheet-like dielectric substrate supporting a receiver coat of dye-receptive material on one side, characterized in that there are antistatic treatments provided on both sides of the dielectric substrate, such treatments being sufficient on each side to reduce the surface resistivity to less than $1\times10^{13}$ Ω/square. The side of the substrate remote from the receiver layer suitably has an antistatic backcoat for reducing the surface resistivity on that side, and the use of a textured surface provided by particulate materials either in the antistatic backcoat or in a further backcoat overlying the antistatic backcoat, may further improve the handling properties.

15 Claims, 1 Drawing Sheet

THERMAL TRANSFER RECEIVER

Figure 1:
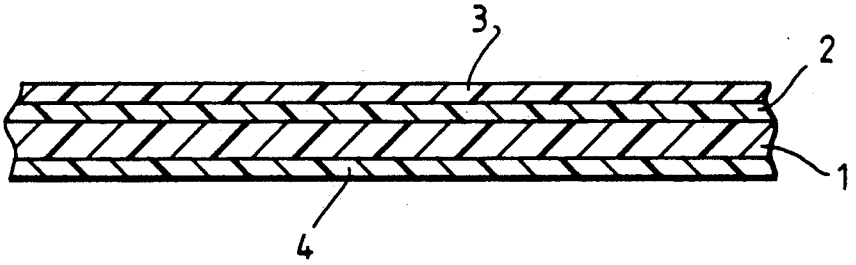

The invention relates to thermal transfer printing, and especially to receiver sheets of novel construction and their use in dye-diffusion thermal transfer printing.

Thermal transfer printing ("TTP") is a generic term for processes in which one or more thermally transferable dyes are caused to transfer from a dyesheet to a receiver in response to thermal stimuli. For many years, sublimation TTP has been used for printing woven and knitted textiles, and various other rough or intersticed materials, by placing over the material to be printed a sheet carrying the desired pattern in the form of sublimable dyes. These were then sublimed onto the surface of the material and into its interstices, by applying heat and gentle pressure over the whole area, typically using a plate heated to 180°–220° C. for a period of 30–120s, to transfer substantially all of the dye.

A more recent TTP process is one in which prints can be obtained on relatively smooth and coherent receiver surfaces using pixel printing equipment, such as a programmable thermal print head or laser printer, controlled by electronic signals derived from a video, computer, electronic still camera, or similar signal generating apparatus. Instead of having the pattern already preformed on the dyesheet, a dyesheet for this process comprises a thin substrate supporting a dyecoat comprising a single dye or dye mixture (usually dispersed or dissolved in a binder) forming a continuous and uniform layer over an entire printing area of the dyesheet. Printing is effected by heating selected discrete areas of the dyesheet while the dyecoat is held against a dye-receptive surface, causing dye to transfer to the corresponding areas of the receptive surface. The shape of the pattern transferred is thus determined by the number and location of the discrete areas which are subjected to heating, and the depth of shade in any discrete area is determined by the period of time for which it is heated and the temperature reached. The transfer mechanism appears to be one of diffusion into the dye-receptive surface, and such printing process has been referred to as dye-diffusion thermal transfer printing.

This process can give a monochrome print in a colour determined by the dye or dye-mixture used, but full colour prints can also be produced by printing with different coloured dyecoats sequentially in like manner. The latter may conveniently be provided as discrete uniform print-size areas, in a repeated sequence along the same dyesheet.

A typical receiver sheet comprises a sheet-like substrate supporting a receiver coat of a dye-receptive composition containing a material having an affinity for the dye molecules, and into which they can readily diffuse when the adjacent area of dyesheet is heated during printing. Such receiver coats are typically around 2–6 μm thick, and examples of suitable dye-receptive materials include saturated polyesters, preferably soluble in common solvents to enable them readily to be applied to the substrate as coating compositions and then dried to form the receiver coat.

Various sheet-like materials have been suggested for the substrate, including for example, cellulose fibre paper, thermoplastic films such as biaxially orientated polyethyleneterephthalate film, plastic films voided to give them paper-like handling qualities (hence generally referred to as "synthetic paper"), and laminates of two or more such sheets. However, we have observed that some receiver sheets, suffer from poor handling properties, this being especially noticeable when they are stored in packs of unused receiver sheets and stacks of prints made from them. Indeed, whenever individual sheets may be moved relative to adjacent sheets with which they are in contact, such sheets generally tend to stick together, rather than slide easily one sheet over another.

We have found such problems to be due to a number of different causes, but to be particularly prevalent in sheets based on thermoplastic films, synthetic papers and some cellulosic papers that are dielectric materials, i.e. materials that readily build up charges of static electricity on their exposed surfaces. However, having tried adding antistatic agents to the receiver coat, and even adding a conducting undercoat as described in our copending application of even date, only marginal improvements in the handling characteristics of such receivers were observed. We have now found that if, in addition to such treatments of the receiver layer side, we also apply suitable antistatic treatment to the side remote from the receiver layer, handling properties may be dramatically improved.

According to a first aspect of the present invention, a receiver sheet for dye-diffusion thermal transfer printing comprises a sheet-like dielectric substrate supporting a receiver coat of dye-receptive material on one side, characterised in that there are antistatic treatments provided on both sides of the dielectric substrate, such treatments being sufficient on each side to reduce the surface resistivity to less than $1\times10^{13}$ Ω/square.

A preferred receiver sheet is one which, to provide the antistatic treatment on the side of the substrate remote from the receiver coat, has a antistatic backcoat comprising:

(a) a thermoset cross-linked polymer matrix stable to elevated temperatures of at least 150° C., and (b) an antistatic agent sufficient to reduce the surface resistivity to less than $1\times10^{13}$ Ω/square.

A preferred receiver is one having an exposed backcoat surface which is textured, the texture being provided by a layer of inert particulate material within the size range 2 to 10 μm in diameter embedded in a thermoset cross-linked polymer matrix stable to elevated temperatures of at least 150° C. The particulate material preferably comprises a mixture of small and large particles, at least 90% of the particles being within the size ranges 2–3 μm and 5–7 μm, with the particles distributed between the two size ranges according to a ratio in the range 1:2 to 1:5. Suitable are silica particles such as Gasil 244 (Crosfield) and Syloid 244 (Grace), but other inert particles, such as alumina and particulate polymeric materials, may also be used, as may mixtures of different particles falling within the size ranges stated above.

We find that such textured surfaces can improve winding characteristics of long webs during manufacture of receiver sheet, and can facilitate sliding of cut receiver sheets, one over the other when stacked before or after printing. The roughness of such surfaces may also help to reduce slip when being transported by the printer during printing, and may also enable one to write on that back surface.

For the reasons described in our copending application referred to above, we prefer to provide the antistatic treatment to the receiver side, by providing a separate conductive undercoat underlying the receiver coat. The side of the substrate remote from the receiver layer may similarly have a plurality of backcoats comprising the textured backcoat and the antistatic backcoat as separately applied coatings, with the antistatic coating underlying that containing the inert particles.

However, the problems associated with the receiver coat which made us prefer generally to provide a separate conducting undercoat as the antistatic treatment on that side, do not apply in respect of the backcoat, and consequently we prefer to apply both the antistatic and textured layers in a single coating operation. Thus our preferred receiver sheet is one in which both the antistatic backcoat and the textured backcoat are combined in the same backcoat. Such a combined backcoat suitably comprises an acid catalysed composition consisting essentially of:

(a) a thermoset cross-linked polymer matrix stable to elevated temperatures of at least 150° C., (b) an antistatic agent sufficient to reduce the surface resistivity to less than $1\times10^{13}$ Ω/square, and (c) particulate material comprising a mixture of small and large particles, at least 90% of the particles being within the size ranges 2–3 μm and 5–7 μm, with the particles distributed between the two size ranges according to a ratio within the range 1:2 to 1:5.

The proportion of particulate material to thermoset polymer in such a combined backcoat can be varied over a considerable range and still provide an effective backcoat. Our preferred range is from 0.5 to 8% by weight of the polymer. Quantities less than 0.5% tend to be increasingly less effective, while quantities greater than 8% tend to produce compositions which become increasingly difficult to apply as even coatings. Such higher loadings also produce mat finishes, and lower loadings are preferred for transparent prints, e.g. for overhead projection. For most applications we generally prefer the particulate material to be in quantities between 1 and 5% by weight of the polymer. The effect, however, changes only gradually with changes in the proportions, and particle loadings outside these ranges can be used to good effect in some applications.

The thermoset cross-linked matrix is preferably the reaction product of an organic solvent-soluble polymeric material having a plurality of reactive hydroxyl groups per molecule, and a crosslinking agent reactive with the hydroxyl groups of the solvent-soluble polymer, the functionality of one of the polymer and cross-linking agent being at least 2, and the functionality of the other being at least 3, thereby to produce a multi-cross-linked polymer matrix.

Preferred thermoplastic polymers are solvent-soluble terpolymers of vinyl acetate, vinyl chloride and vinyl alcohol, e.g. VROH terpolymers (Union Carbide). Suitable solvents for these have some polarity, but solvents should be chosen which are also solvents for the cross linking agent. Examples of generally useful solvents include acetone, diacetone alcohol (DAA) and isopropanol. The solvent-soluble polymeric material may also be selected from very low molecular weight compounds, such as those described for the conductive undercoat hereinafter. These include polyalkylene glycols having terminal hydroxyl groups, such as polypropylene glycol or even diethylene glycol.

Preferred crosslinking agents are polyfunctional N-(alkoxymethyl) amine resins having at least three alkoxymethyl groups per molecule which are available to react with the hydroxyl groups of the solvent-soluble polymeric materials, i.e. with the VROM terpolymer, polyalkylene glycols and other hydroxyl-containing polymers referred to above, thereby to provide its polyfunctionality. Such cross-linking agents include alkoxymethyl derivatives of urea, guanamine and melamine resins. Lower alkyl compounds (i.e. up to the $C_4$ butoxy derivatives) are available commercially and all can be used effectively, but the methoxy derivative is much preferred because of the greater ease with which its more volatile by-product (methanol) can be removed afterwards.

Examples of the latter which are sold by American Cyanamid in different grades under the trade name Cymel, are the hexamethoxymethylmelamines, suitably used in a partially prepolymerised (oligomer) form to obtain appropriate viscosities. Hexamethoxymethylmelamines are 3–6 functional, depending on the steric hindrance from substituents, and are capable of forming highly cross-linked materials using suitable acid catalysts, e.g. p-toluene sulphonic acid (PTSA). However, the acids are preferably blocked when first added, to extend the shelf life of the coating composition. Examples include amine-blocked PTSA (e.g. Nacure 2530) and ammonium tosylate.

Preferred antistatic backcoats comprise the thermoset cross-linked polymer matrix doped with an alkali metal salt as the antistatic agent. The conductivity can be increased steadily by increasing the amount of the alkali metal salt, but this we find leads to increasing hygroscopic properties, and we prefer to use as little alkali metal salt as will provide adequate conduction. We find that the alkali metals of lower atomic number are the most efficacious, and accordingly prefer to use lithium salts. Lithium salts of organic acids are particularly preferred, although we have also had some good results using lithium nitrate or lithium thiocyanate. Suitable amounts generally for lithium salts is 0.05–5% of the total solids in the antistatic backcoat.

The present invention can provide benefit for a variety of receivers having dielectric substrates. It is particularly beneficial where the substrate is a sheet of thermoplastic film. It can also usefully be employed on synthetic paper, and some cellulosic papers for which static build-up might present handling problems. Laminates can also benefit from the same treatment where the laminate comprises a plurality of sheets bonded together, at least one of which is formed of a dielectric material, such as thermoplastic film.

Receiver sheets according to the first aspect of the invention can be sold and used in the configuration of long strips packaged in a cassette, or cut into individual print size portions, or otherwise adapted to suit the requirements of whatever printer they are to be used with, whether or not this incorporates a thermal print head to take full advantage of the properties provided hereby. All such forms provide for some sheets moving over others, or some parts of a long web sliding against other parts, and in all such cases the ability of the present receiver sheets to slide so easily over each other, reduces or overcomes the handling problems that otherwise may occur.

Thus according to a second aspect of the invention, we provide a stack of print size portions of a receiver sheet according to the first aspect of the invention, packaged for use in a thermal transfer printer. This second aspect has particular advantage in that the conductive layers enable the sheets to be fed individually from the stack to a printing station in a printer, unhindered by static-induced blocking. There is also less risk of dust pick-up.

Figure 2:
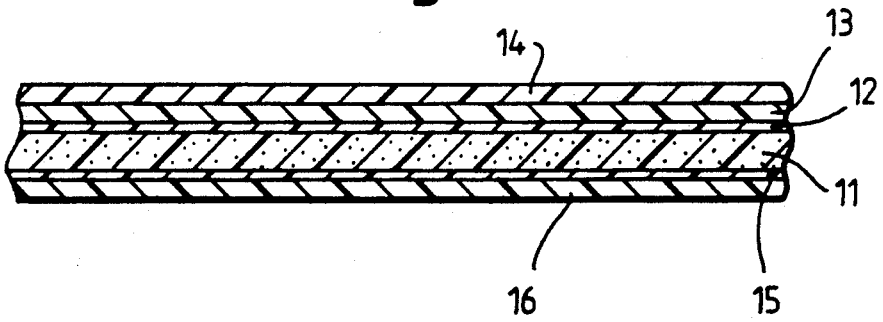

The invention is illustrated by reference to specific embodiments shown in the accompanying drawings, in which:

FIG. 1 is a diagrammatical representation of a cross section through a receiver according to the present invention, and FIG. 2 is a diagrammatical representation of a cross section through a second receiver according to the present invention.

The receiver sheet shown in FIG. 1 has a substrate of biaxially orientated polyethyleneterephthalate film 1. Coated onto one side of this is a conducting undercoat 2 of the present invention, overlain by a receptive layer 3. On the reverse side is an antistatic backcoat 4.

The receiver sheet shown in FIG. 2 uses synthetic paper 11 for the substrate. This has a subbing layer 12, conducting undercoat 13, and receptive layer 14, and on the reverse side is a further subbing layer 15 and a backcoat 16.

EXAMPLE 1

To illustrate further the present invention, receiver sheets were prepared essentially as shown in FIG. 1. A large web of transparent biaxially orientated polyester film was provided on one side with a conductive undercoat overlayed with a receiver coat, and with a antistatic backcoat on the other, as described below.

The first coat to be applied to the web was the backcoat. One surface of the web was first chemically etched to give a mechanical key. A coating composition was prepared from three solutions as follows:

| | |
|---|---|
| thermoset precursor | |
| VROH | 4.0 g |
| Cymel 303 | 1.4 g |
| Nacure 2530 | 1.0 g |
| acetone | 85.0 l |
| diacetone-alcohol | 8.5 l |
| antistatic solution | |
| $LiNO_3$ | 0.1 g |
| isopropanol | 0.5 ml |
| particulate filler dispersion | |
| acetone | 74 g |
| Diakon MG102 | 17.5 g |
| Gasil EBN | 1.8 g |
| Syloid 244 | 6.6 g |

(VROH is a solvent-soluble terpolymer of vinyl acetate, vinyl chloride and vinyl alcohol sold by Union Carbide, Gasil EBN and Syloid 244 are brands of silica particles sold by Crosfield and Grace respectively, and Diakon MG102 is a polymethylmethacrylate sold by ICI).

Shortly before use, the antistatic solution was added to the thermoset precursor, followed by the filler dispersion at the rate of 60 ml of the latter to 5 l of the combined thermoset/antistatic solution. The resultant composition was then coated onto the etched surface, dried and cured to form a 1.5–2 μm thick backcoat.

The conductive undercoat composition consisted of:

| | |
|---|---|
| methanol | (solvent) |
| PVP K90 | 20 parts by weight |
| Cymel 303 | 40 parts by weight |
| K-Flex 188 | 5 parts by weight |
| Digol | 15 parts by weight |

-continued

| | |
|---|---|
| PTSA | 20 parts by weight |
| $LiOH.H_2O$ | 3.2 parts by weight |

(K-Flex is a polyester polyol sold by King Industries and PVP is polyvinyl pyrrolidone, both being added to adjust the coating properties.)

This composition was prepared, as above, by preparing separate solutions of the reactive ingredients, and mixing these shortly before use. This composition was machine coated onto the opposite side of the substrate from the backcoat, dried and cured to give a dry coat thickness of about 1 μm.

The receiver layer coating composition also used Cymel 303 and an acid catalysed system compatible with the conductive undercoat, and consisted of:

| | |
|---|---|
| toluene/MEK | 60/40 solvent mixture |
| Vylon 200 | 100 parts by weight |
| Tegomer H—Si 2210 | 1.3 parts by weight |
| Cymel 303 | 1.8 parts by weight |
| Tinuvin 900 | 2.0 parts by weight |
| Nacure 2530 | 0.2 parts by weight |

(Tegomer H-Si 2210 is a bis-hydroxyalkyl polydimethylsiloxane, cross-linkable by the Cymel 303 under acid conditions to provide a release system effective during printing, being sold by Th Goldschmidt.)

This coating composition was made (as before) by mixing three functional solutions, one containing the dye-receptive Vylon and the Tinuvin UV absorber, a second containing the Cymel cross linking agent, and the third containing both the Tegomer silicone release agent and the Nacure solution to catalyse the crosslinking polymerisation between the Tegomer and Cymel materials. Using in-line machine coating, the receiver composition was coated onto the conductive undercoat, dried and cured to give a dye-receptive layer about 4 μm thick.

Examination of the coated web showed that the highly cross-linked backcoat had proved stable to the solvents and elevated temperatures used during the subsequent provision of the other two coatings. The web of coated film was then chopped into individual receiver sheets, and stacked and packaged for use in a thermal transfer printer. During these handling trials, and during normal printing, the sheets were found to side easily, one over another, and to feed through the printer without any observed misfeeding of the sheet. The receiver sheets were clear and transparent before printing, which properties were retained during printing to give high quality transparencies for overhead projection, with no evidence of total transfer having occurred during printing.

The surface resistivities were measured on both sides of the receiver sheet, at 20° C. and 50% humidity. Values of about $1\times10^{11}$ Ω/square were obtained on the backcoat, and values of about $1\times10^{12}$ Ω/square on the surface of the receiver coat.

EXAMPLE 2

The above Example was repeated using an opaque white substrate of Melinex 990 biaxially orientated polyester film (ICI). A backcoat was first applied followed by a conductive undercoat, both of these having the same composition as in Example 1. The receiver coat composition was modified, however, this being:

| | |
|---|---|
| toluene/MEK | 60/40 solvent mixture |
| Vylon 200 | 100 parts by weight |
| Tegomer H—Si 2210 | 0.7 parts by weight |
| Cymel 303 | 1.4 parts by weight |
| Tinuvin 900 | 1.0 parts by weight |
| Nacure 2530 | 0.2 parts by weight |

The receiver sheets had the same good handling characteristics as the transparencies of Example 1, and again there was no evidence of any total transfer occurring during printing.

We claim:

1. A receiver sheet for dye-diffusion thermal transfer printing comprises a dielectric substrate supporting a receiver coat of dye-receptive material on one side, characterised in that there are antistatic coatings provided on both sides of the dielectric substrate, such coatings being sufficient on each side to reduce the surface resistivity to less than $1\times10^{13}$ Ω/square.

2. A receiver sheet as claimed in claim 1, characterised in that to provide the antistatic coating on the side of the substrate remote from the receiver coat, it has an antistatic backcoat comprising (a) a thermoset cross-linked polymer matrix stable to elevated temperatures of at least 150° C., and (b) an antistatic agent sufficient to reduce the surface resistivity to less than $1\times10^{13}$ Ω/square.

3. A receiver sheet as claimed in claim 2, characterised in that the thermoset cross-linked polymer matrix is the reaction product of an organic solvent-soluble, thermoplastic polymeric material having a plurality of reactive hydroxyl groups per molecule, and a crosslinking agent reactive with the hydroxyl groups of the thermoplastic polymer, the functionality of one of the polymer and cross-linking agent being at least 2, and the functionality of the other being at least 3, thereby to produce a multi-crosslinked polymer matrix.

4. A receiver sheet as claimed in claim 3, characterised in that the crosslinking agent is a polyfunctional N-(alkoxymethyl) amine resin having at least three alkoxymethyl groups per molecule which are available to react with the hydroxyl groups, thereby to provide its polyfunctionality.

5. A receiver sheet as claimed in claim 4, characterised in that the crosslinking agent is a hexamethoxymethylmelamine.

6. A receiver sheet as claimed in claim 2, characterised in that the antistatic backcoat comprises the thermoset cross-linked polymer matrix doped with an alkali metal salt as the antistatic agent.

7. A receiver sheet as claimed in claim 6, characterised in that the alkali metal is lithium,

8. A receiver sheet as claimed in claim 7, characterised in that the lithium salts include salts of organic acids.

9. A receiver sheet as claimed in claim 1, characterised in that it has an exposed backcoat surface which is textured, this textured backcoat being provided by a layer of inert particulate material within the size range 2 to 10 μm in diameter, embedded in a thermoset cross-linked polymer matrix stable to elevated temperatures of at least 150° C.

10. A receiver sheet as claimed in claim 9, characterised in that the particulate material comprises a mixture of small and large particles, at least 90% of the particles being within the size ranges 2–3 μm and 5–7 μm, with the particles distributed between the two size ranges according to a ratio within the range 1:2 to 1:5.

11. A receiver sheet as claimed in claim 9, characterised in that it has a plurality of backcoats comprising the textured backcoat and the antistatic backcoat as separately applied coatings, with the antistatic backcoat underlying the textured backcoat containing the inert particles.

12. A receiver sheet as claimed in claim 9, characterised in that the antistatic backcoat and the textured backcoat are combined in the same backcoat, comprising an acid catalysed composition consisting essentially of (a) a thermoset cross-linked polymer matrix stable to elevated temperatures of at least 150° C., (b) an antistatic agent sufficient to reduce the surface resistivity to less than $1\times10^{13}$ Ω/square, and (c) particulate material comprising a mixture of small and large particles, at least 90% of the particles being within the size ranges 2–3 μm and 5–7 μm, with the particles distributed between the two size ranges according to a ratio within the range 1:2 to 1:5.

13. A receiver sheet as claimed in claim 1, characterised in that the substrate is a sheet of thermoplastic film.

14. A receiver sheet as claimed in claim 1, characterised in that the substrate is a laminate comprising a plurality of sheets at least one of which is formed of a thermoplastic material.

15. A stack of print size portions of a receiver sheet according to any one of the preceding claims, packaged for use in a thermal transfer printer.

* * * * *